US007114690B2

(12) United States Patent
Bissen

(10) Patent No.: US 7,114,690 B2
(45) Date of Patent: Oct. 3, 2006

(54) UNIVERSAL MAST SUPPORT FRAME AND METHOD FOR MOUNTING MASTS

(75) Inventor: David R. Bissen, Plymouth, MN (US)

(73) Assignee: Schwing America, Inc., White Bear Lake, MN (US)

( * ) Notice: Subject to any disclaimer, the term of this patent is extended or adjusted under 35 U.S.C. 154(b) by 604 days.

(21) Appl. No.: 10/043,066

(22) Filed: Jan. 9, 2002

(65) Prior Publication Data

US 2002/0112441 A1 Aug. 22, 2002

Related U.S. Application Data

(60) Provisional application No. 60/270,437, filed on Feb. 21, 2001.

(51) Int. Cl.
*A47G 1/10* (2006.01)

(52) U.S. Cl. ..... 248/316.2; 248/56; 52/736.1

(58) Field of Classification Search ..... 248/316.2, 248/251, 56, 57, 74.5, 313; 52/736.1, 736.2, 52/643, 648.1
See application file for complete search history.

(56) References Cited

U.S. PATENT DOCUMENTS 1,680,050 A * 8/1928 Keppens ..... 248/527
1,749,135 A * 3/1930 Harter ..... 248/56
2,970,798 A * 2/1961 Friotchle et al. ..... 248/229.25
4,834,186 A * 5/1989 Ballard ..... 169/16
4,842,231 A * 6/1989 Warshawsky ..... 248/316.2
5,603,389 A * 2/1997 Zemon ..... 182/133
5,661,946 A * 9/1997 Davis ..... 52/736.1
5,732,909 A * 3/1998 Sonnier ..... 248/49
6,155,018 A * 12/2000 Yang ..... 52/736.4
6,220,557 B1 * 4/2001 Ziaylek et al. ..... 248/316.1
6,585,207 B1 * 7/2003 Ibbitson et al. ..... 248/229.2
6,752,368 B1 * 6/2004 Winchip et al. ..... 248/316.2

OTHER PUBLICATIONS

Schwing America, Inc. sales brochure, "KVM 28, KVM 32, DVM 32, DVM 42 Separate Placing Booms", Feb. 1999, 4 pages.
"Frequent Flyer Program For Concrete Booms", Concrete Construction Magazine, 4 pages, published prior to Feb. 21, 2001.
"KVM 28/28X Load Chart Wall Supported", Schwing America, Inc., Marketing drawing, 1 page, distributed prior to Feb. 21, 2001.
"Putzmeister America MXR32 Placing Boom Standard Layout", Putzmeister America Marketing drawing, 4 pages, received prior to Feb. 21, 2001.
Schwing America, Inc. sales brochure, "Separate Placing Booms and Their Fields of Application," published prior to Feb. 21, 2001.

* cited by examiner

*Primary Examiner*—Korie Chan
(74) *Attorney, Agent, or Firm*—Kinney & Lange, P.A.

(57) ABSTRACT

A support apparatus used with construction masts. The support apparatus comprises a truss and a top adjustable mount assembly secured to the truss. The top adjustable mount assembly is selectively positionable so as to engage the construction mast.

29 Claims, 11 Drawing Sheets

UNIVERSAL MAST SUPPORT FRAME AND METHOD FOR MOUNTING MASTS

CROSS-REFERENCE TO RELATED APPLICATIONS

This application claims the benefit of Provisional Application No. 60/270,437 filed Feb. 21, 2001 for "Universal Mast Support Frame" by David R. Bissen, which is incorporated by reference in its entirety herein.

BACKGROUND OF THE INVENTION

This invention is in the field of mast systems for supporting, conveying and/or hoisting booms, as well as derricks and personnel lift equipment. In particular, the invention addresses the mounting of masts using mast supports.

Construction works in industrial or municipal plants frequently require the hoisting, conveyance and/or placement of materials, equipment and personnel for construction of facilities or plant operation. Properly constructed and installed, boom and personnel lift systems offer a safe, cost effective and efficient method of accomplishing these tasks. Mast systems (either tubular masts or lattice towers) are currently used to allow boom, crane and personnel lift equipment to be installed at an elevated position, typically 10–250 feet above grade elevation or at the top of a building or structure. The minimum size of the mast, both in diameter and in length, is dictated by a variety of loads on the mast, including the load from the supported equipment, operating loads (e.g., material being hoisted) which generate an overturning moment, vertical and horizontal loads, wind and snow loads and other vertical and horizontal loads. In order to minimize the load reactions at the mast anchorage points and on the structure to which the mast is anchored, it is desirable to use the smallest and lightest mast allowed by engineering requirements for the particular application.

It is known to provide mounting systems for masts by attaching supporting trusses to vertical walls. Previous systems, however, were specially designed to accommodate a single mast size. Thus, if a construction firm owned more than one mast, it was necessary for the firm to purchase multiple mounting systems in order to accommodate each differently sized mast. If it became desirable to change mast sizes during the job, the mounting system would need to be changed. This usually required unbolting the mounting system from the wall in order to allow for the changing of the mast.

BRIEF SUMMARY OF THE INVENTION

A support apparatus used with construction masts. The support apparatus comprises a truss and a top adjustable mount assembly secured to the truss. The top adjustable mount assembly is selectively positionable so as to engage the construction mast.

DETAILED DESCRIPTION

Figure 1:
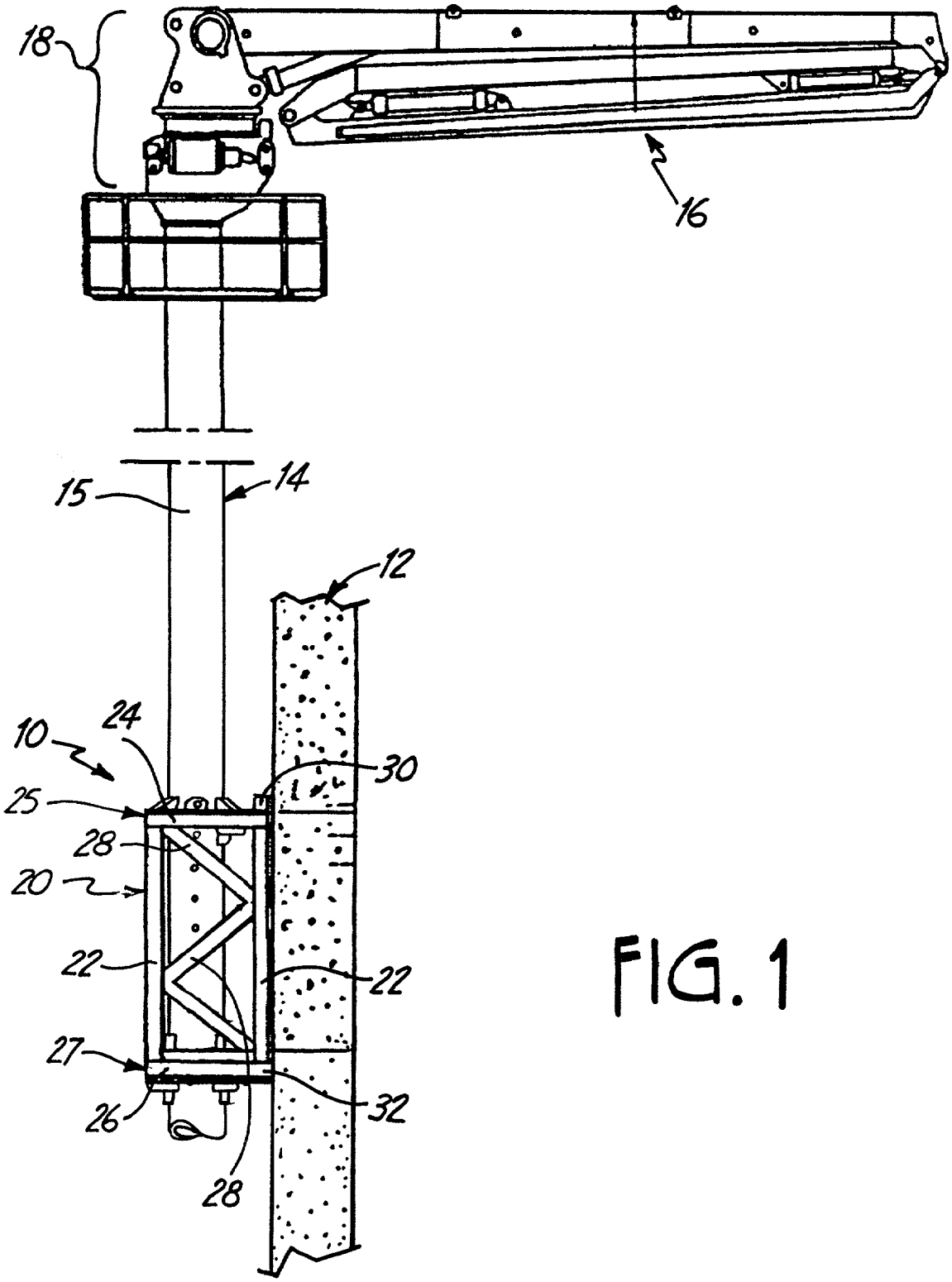
FIG. 1 is an elevational view of a boom and mast supported by the inventive mast support assembly.

FIG. 1 shows a mast support assembly 10 attached to a vertical wall 12 with a construction mast 14 supported therein. The mast 14 has an outer wall 15 and is shown connected to an articulated boom system 16. The articulated boom system 16 is attached to the mast 14 at a pin-connected tower/turret assembly 18. It should be understood that the articulated boom system 16 and the pin-connected tower/turret assembly 18 are shown for illustrative purposes only. Other equipment can be supported by the mast 14. For example, hoisting cranes, derricks and personnel lifts, among other equipment could be supported by the mast 14.

The mast support assembly 10 includes a truss 20, having vertical members 22, top frame tubes 24 (forming a top frame portion 25), bottom frame tubes 26 (forming a bottom frame portion 27) and lacing members 28. In one embodiment, the vertical and lacing members 22 and 28 are made from approximately 5 inch by approximately 5 inch square steel tubes. The top and bottom frame tubes 24 and 26 are made of 7 inch (vertically extending surface) by 5 inch (horizontally extending surface) steel tubes. Other sizes and cross-sectionally shaped tubes made of a variety of different materials could be used to form the truss 20. The truss 20 is mounted to the wall 12 at a top wall anchorage 30 and a bottom wall anchorage 32. While a wall is illustrated in FIG. 1, a person skilled in the art would realize that the truss can be mounted to other structures, such as concrete floors, steel framework, structural pilings, ballasted frames, and marine barges.

Figure 2:
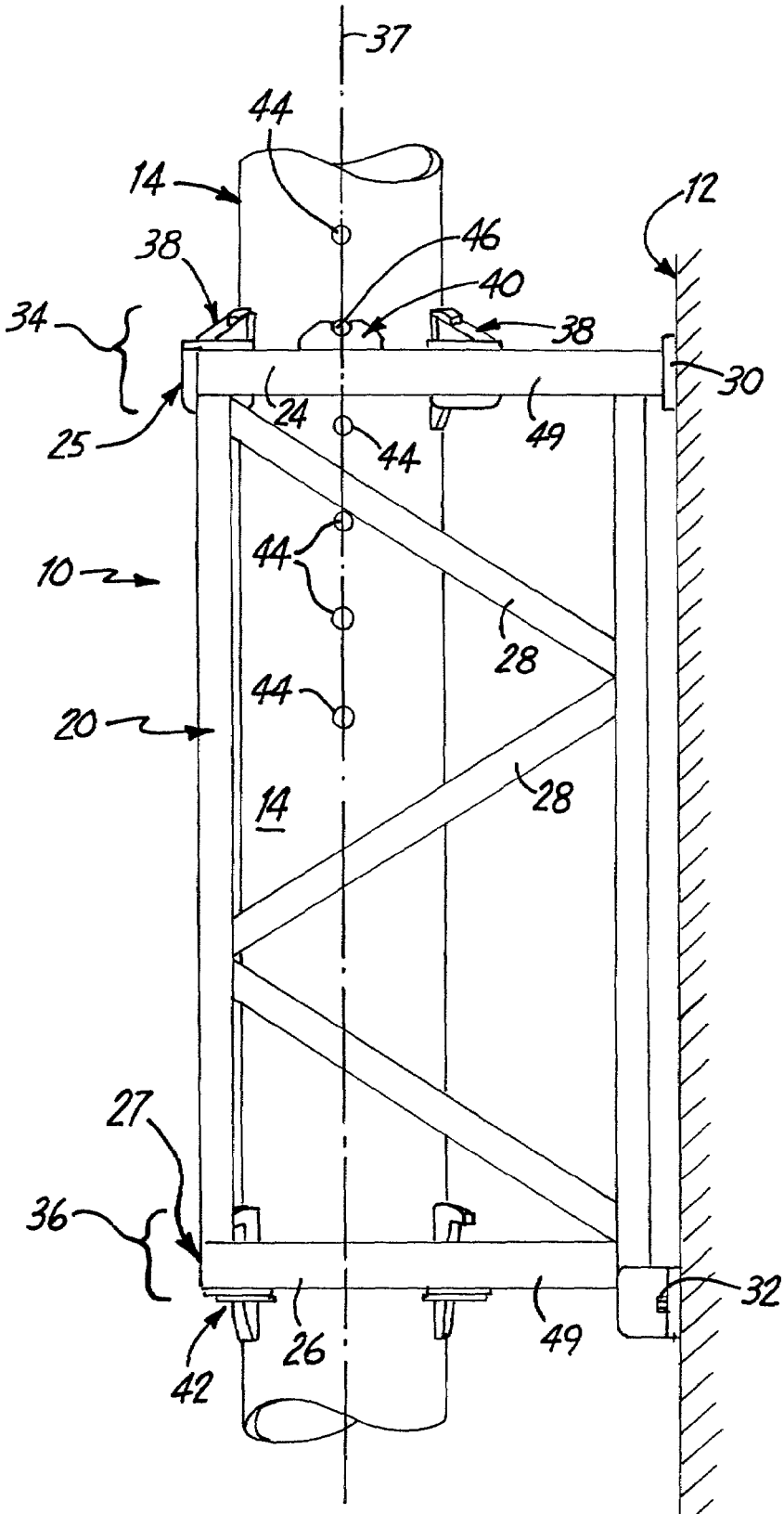
FIG. 2 is an elevational view of the mast support assembly supporting a mast and mounted to a wall.

The mast 14 is secured to the truss 20 by a top adjustable mount assembly 34 and a bottom adjustable mount assembly 36, and defines a longitudinal axis 37 through the mast support assembly 10 as shown in FIG. 2. Typically, the mast 14 has either an outer cross-sectional diameter of approximately 24 inches, approximately 28 inches or approximately 32 inches although any number of mast diameter sizes can be used in the inventive mast support assembly 10. Typically the mast 14 is hollow and the thickness of the mast wall is approximately ½ inch.

The top adjustable mount assembly 34 includes top wedge bracket assemblies 38 and pin cradle assemblies 40. The bottom adjustable mount assembly 36 includes bottom wedge bracket assemblies 42. Although the bottom adjustable mount assembly 36 does not include pin cradles (as is shown in the top adjustable mount assembly 34) a person skilled in the art would realize that pin cradles could be included in the bottom adjustable mount assembly without departing from the spirit and scope of the invention. Cross pin holes 44 are disposed completely through the mast 14. A cross pin 46 is selectively disposed through one of the cross pin holes 44 and each end of the cross pin is supported by one of the pin cradle assemblies 40, allowing the mast 14 to be positioned vertically within the mast support assembly 10. Positioning the mast 14 vertically is accomplished by removing the cross pin 46, raising or lowering the mast 14 (typically using a crane, not shown), aligning one of the cross pin holes 44 with the pin cradle assemblies 40 and re-inserting the cross pin 46. Typically, the cross pin 46 passes radially through the longitudinal axis 37 defined by the longitudinally extending mast 14. The cross pin 46 is supported by each of the pin cradle assemblies 40 and extends through the mast 14, holding the mast vertically as well as rotationally about the longitudinal axis 37 in position.

Figure 3:
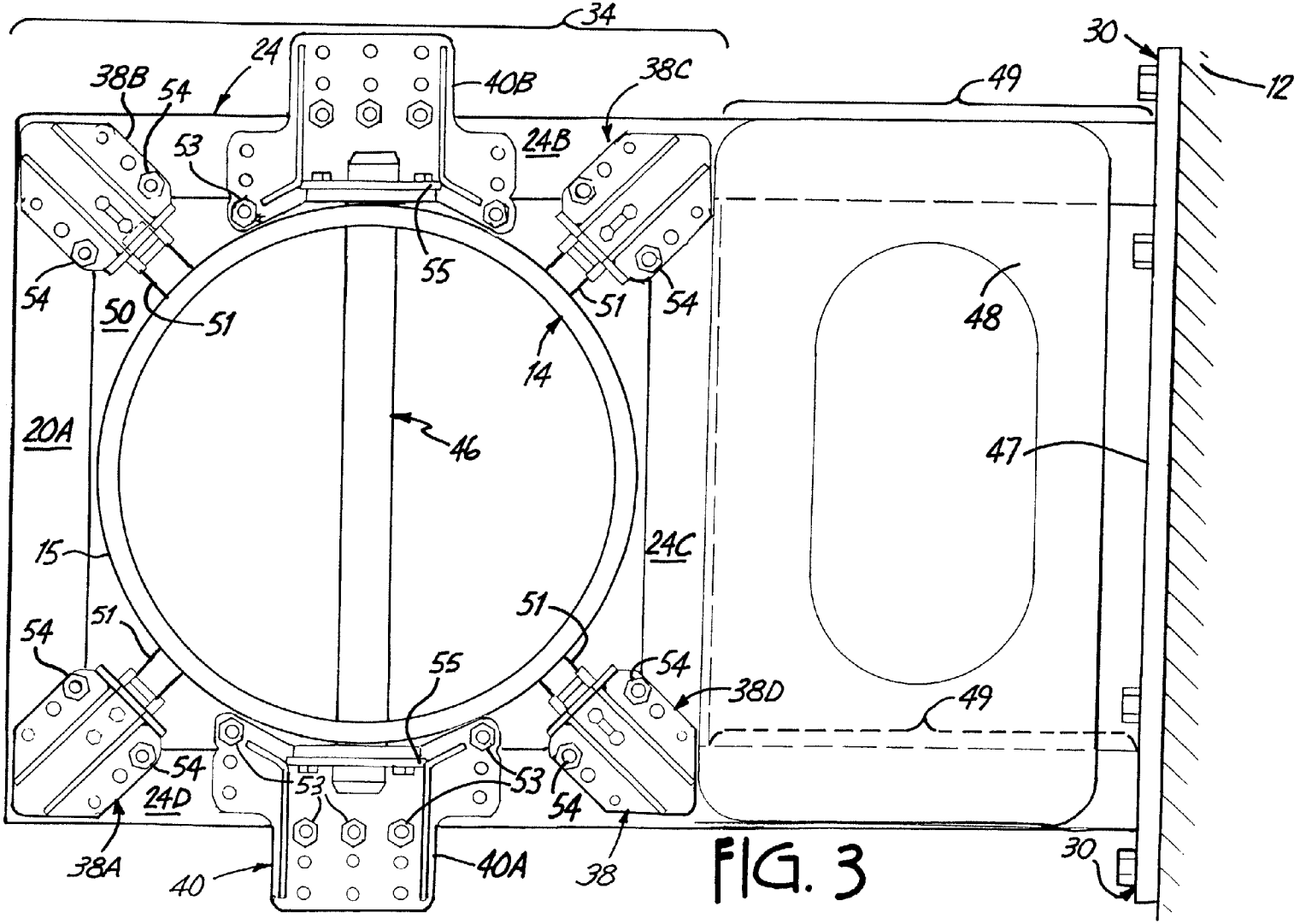
FIG. 3 is a top view of the mast support assembly supporting a mast having a first diameter.

The top wall anchorage 30 and bottom wall anchorage 32 are bolted to the wall 12 in a manner known to those skilled in the art. In one embodiment, the top wall anchorage 30 includes a mounting plate 47 extending at least the width of the top adjustable mount assembly 34, as best shown in FIG. 3. The plate 47 is bolted to the wall 12 (or other support structure) and the top frame tubes 24 are fixed to the plate 47, such as by welding. Using mounting plates in this fashion has the advantage of providing structural stability to the truss 20.

If additional structured stability is desired, a stiffening plate 48 may be fixed to the truss 20. The stiffening plate 48 is mounted to mounting portions 49 of the top frame tubes 24. While the stiffening plate 48 is shown mounted onto a top surface of each of the mounting portions 49, the stiffening plate 48 can be varied in size and points of fixation on other surfaces of the mounting portions 49 (e.g., under the mounting portions 49). Additionally, the stiffening plate 48 may be solid or may include cutout portions to lighten the plate (depending on engineering considerations such as strength, stability and weight of the mast support assembly 10). Additional stabilizing members (such as plates and struts) may be added to the mast support assembly 10 to further strengthen the mast support assembly 10, depending on the applications and environment for which the mast support assembly 10 is designed.

The mounting portions 49 are used to provide a separation between the wall 12 and the top and bottom frame tubes 24 and 26. Typically, approximately three feet of separation is provided, although other separation distances are contemplated (including no separation) without departing from the spirit and scope of the invention. While the mounting portions 49 are illustrated as integral pieces of the top frame tubes 24, the mounting portions 49 can be separate elements (steel tubes, etc.) welded or otherwise fixed in place. The separation distance between the wall and the mast 14 allows for easier operator access when the mast is being mounted into the mast support assembly 10.

As shown, two pin cradle assemblies 40A and 40B and four top wedge bracket assemblies 38A–38D are mounted to the top adjustable mount assembly 34. As discussed, the pin cradle assemblies 40 hold the mast 14 vertically as well as preventing the mast 14 from rotating. The wedge bracket assemblies 38A–38D prevent the mast 14 from moving transversely (i.e., radially) within an area 50 defined by top frame tubes 24A–24D. It should be noted that throughout the specification, specific examples of elements may be referred to with a reference number that includes an appended letter (e.g., top frame tube 24A). On the other hand, when elements are referred to generally or generically, no letter is appended (e.g., top frame tubes 24).

In order to prevent the mast 14 from moving transversely, wedges 51 are driven between the top wedge bracket assemblies 38A–38D and the mast 14, thereby preventing lateral movement of the mast 14, and also assuring (in conjunction with the bottom adjustable mount assembly 36) that the mast 14 will not tip over. In the illustrated embodiment, the wedge bracket assemblies 38A–38D are mounted in the corners of area 50, however in an alternate embodiment, the wedge bracket assemblies 38A–38D could be disposed along the sides of area 50. Additionally, it is not necessary for four wedge bracket assemblies 38 to be provided. An alternate number of wedge bracket assemblies can be provided without departing from the spirit and scope of the invention.

As illustrated, the mast 14 has the largest cross-sectional diameter that is accommodated by the mast support assembly 10. In one embodiment, the area 50 defined by the top frame tubes 24A–24D is approximately 35 inches by approximately 35 inches. This area 50 can be changed to accommodate different ranges of mast sizes and shapes. Additionally, although the area 50 defined by the top frame tubes 24A–24D is illustrated as being substantially square in shape, the top and bottom frame tubes can be disposed such that area 50 has other shapes (e.g., rectangular, triangular) without departing from the spirit and scope of the invention. In the illustrated embodiment of the mast support assembly 10, the outer wall 15 of the largest diameter mast 14 is at least approximately 1½ inches away from the top frame tubes 24A–24D which define area 50.

Figure 4:
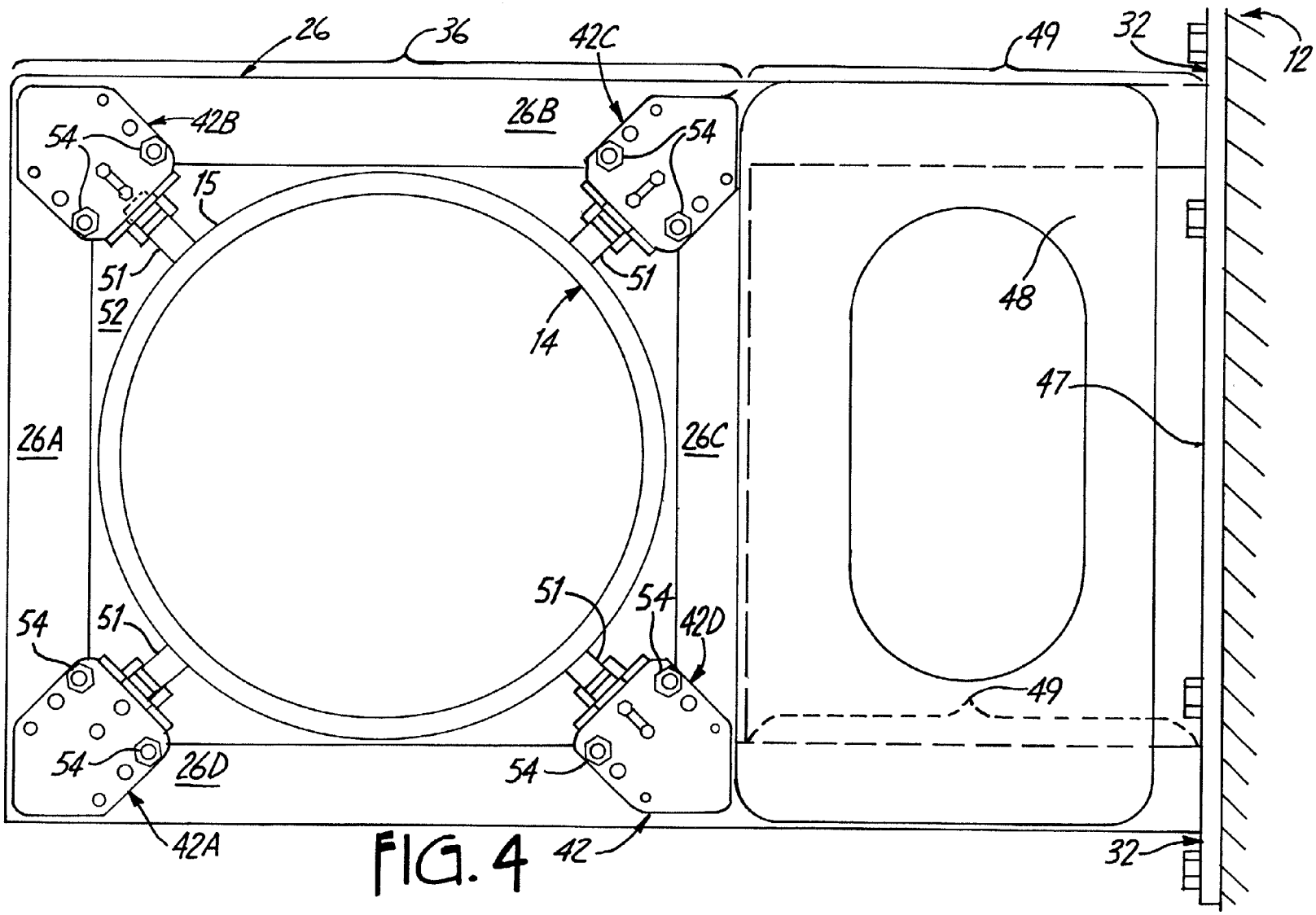
FIG. 4 is a bottom view of the mast support assembly supporting a mast having a first diameter.

The bottom adjustable mount assembly 36 is shown in FIG. 4. A similar mounting plate 47 and stiffening plate 48 configuration as previously described with respect to the top wall anchorage 30 may be used with the bottom wall anchorage 32. One notable difference between the top adjustable mount assembly 34 and the bottom adjustable mount assembly 36 is that no pin cradle assemblies are provided in the illustrated embodiment of the bottom adjustable mount assembly 36. As discussed previously, however, pin cradles may be included in the bottom adjustable mount assembly 36 without departing from the spirit and scope of the invention. The four bottom wedge bracket assemblies 42A–42D are mounted to the bottom frame tubes 26A–26D. Each bottom frame tube member 26A–26D is substantially parallel to and longitudinally aligned with the respective top frame tube members 24A–24D. Wedges 51 are driven between each bottom wedge bracket assembly 42A–42D and the outer wall 15 of the mast 14 to prevent the mast 14 from moving transversely (i.e., radially) within a bottom area 52 defined by the bottom frame tubes 26A–26D. Thus, the mast 14 is secured at both the top adjustable mount assembly 34 and the bottom adjustable mount assembly 36, preventing the mast 14 from tipping over.

Figure 5:
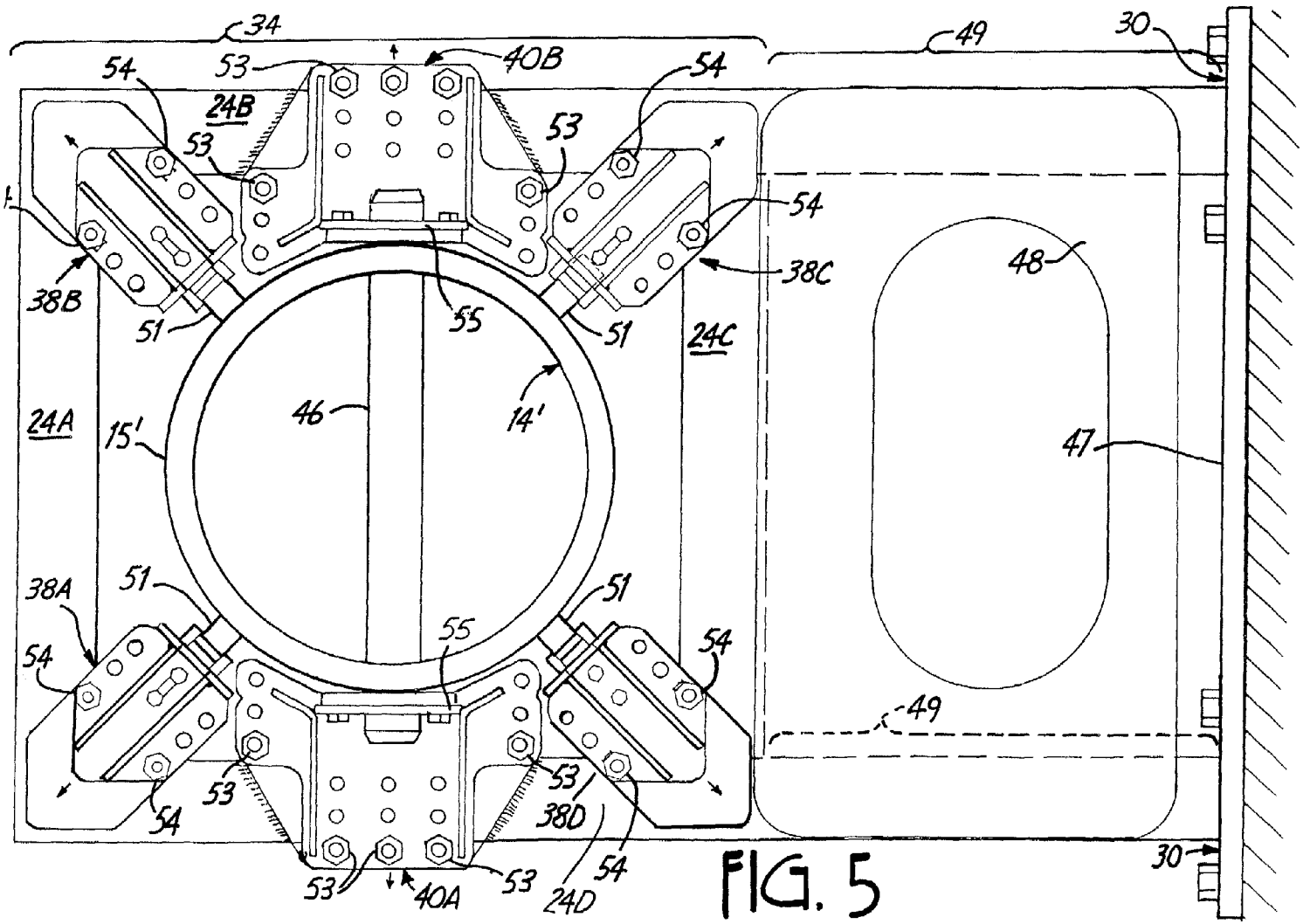
FIG. 5 is a top view of the mast support assembly supporting a mast having a second diameter.

An alternately sized mast 14' may be inserted in the same mast support assembly 10, as illustrated in FIG. 5. As shown, each pin cradle assembly 40A and 40B and wedge bracket assembly 38A–38D in the top adjustable mount assembly 34 can be adjusted radially inward so as to engage the smaller diameter mast 14'.

To adjust each pin cradle assembly 40A and 40B to accommodate the smaller mast 14', a number of cradle mounting bolts 53 are removed, each pin cradle assembly 40 is slid radially inward towards an outer wall 15' of the new mast 14' and the cradle mounting bolts 53 are reinserted and tightened. Moving each pin cradle assembly 40A and 40B towards the new mast 14' minimizes eccentric loads on the cross-pin 46 preventing the failure of the pin 46. Preventing failure of the pin 46 is an important advantage of the inventive mast support assembly 10. Pin failure could cause the mast 14 to fall vertically, creating dire safety consequences as well as causing extreme property damage.

The wedge bracket assemblies 38A–38D may be adjusted similarly to the pin cradle assemblies 40A and 40B by removing wedge bracket bolts 54, sliding the top wedge bracket assemblies 38A–38D radially inward (towards the new mast 14'), re-inserting and tightening the wedge bracket bolts 54, and re-driving the wedges 51 to engage an outer wall 15' of the new mast 14'.

Figure 6:
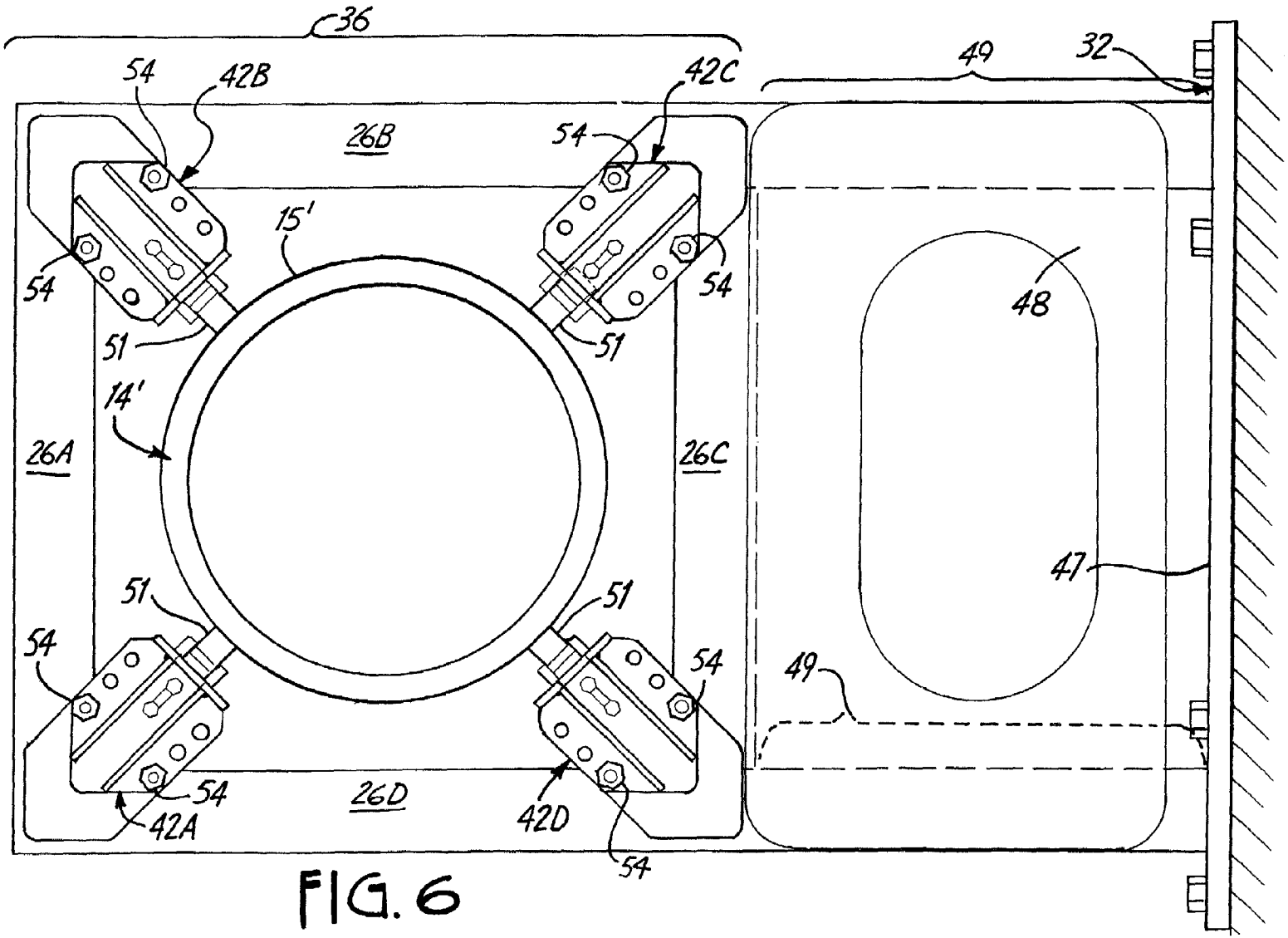
FIG. 6 is a bottom view of the mast support assembly supporting a mast having a second diameter.

Similarly, the bottom adjustable mount assembly 36 is adjusted as shown in FIG. 6. Each wedge bracket assembly 42A–42D can be adjusted radially inward (towards the mast 14') so that each wedge bracket assembly 42A–42D engages the outer wall 15' of the smaller diameter mast 14'. To adjust each bottom wedge bracket assembly 42A–42D, to accommodate the smaller mast 14', the wedge bracket bolts 54 are removed, the bottom wedge bracket assemblies 42A–42D are slid radially inward (toward the mast 14'), and the wedge bracket bolts 54 are re-inserted and tightened. Wedges 51 are then driven between each wedge bracket assembly 42A–42D and the outer wall 15' of the mast 14'.

Thus, various sizes of masts can be mounted within the same inventive mast support assembly 10, eliminating the need to unmount the support assembly any time it is desirable to change the mast. Not having to unbolt the support assembly from the wall in order to change the masts results in saving valuable job time as well as eliminating the added expense of purchasing additional support systems to accommodate different sized masts. The inventive mast support assembly 10 allows for these different mast sizes while still providing a secure and safe mounting system.

Figure 7:
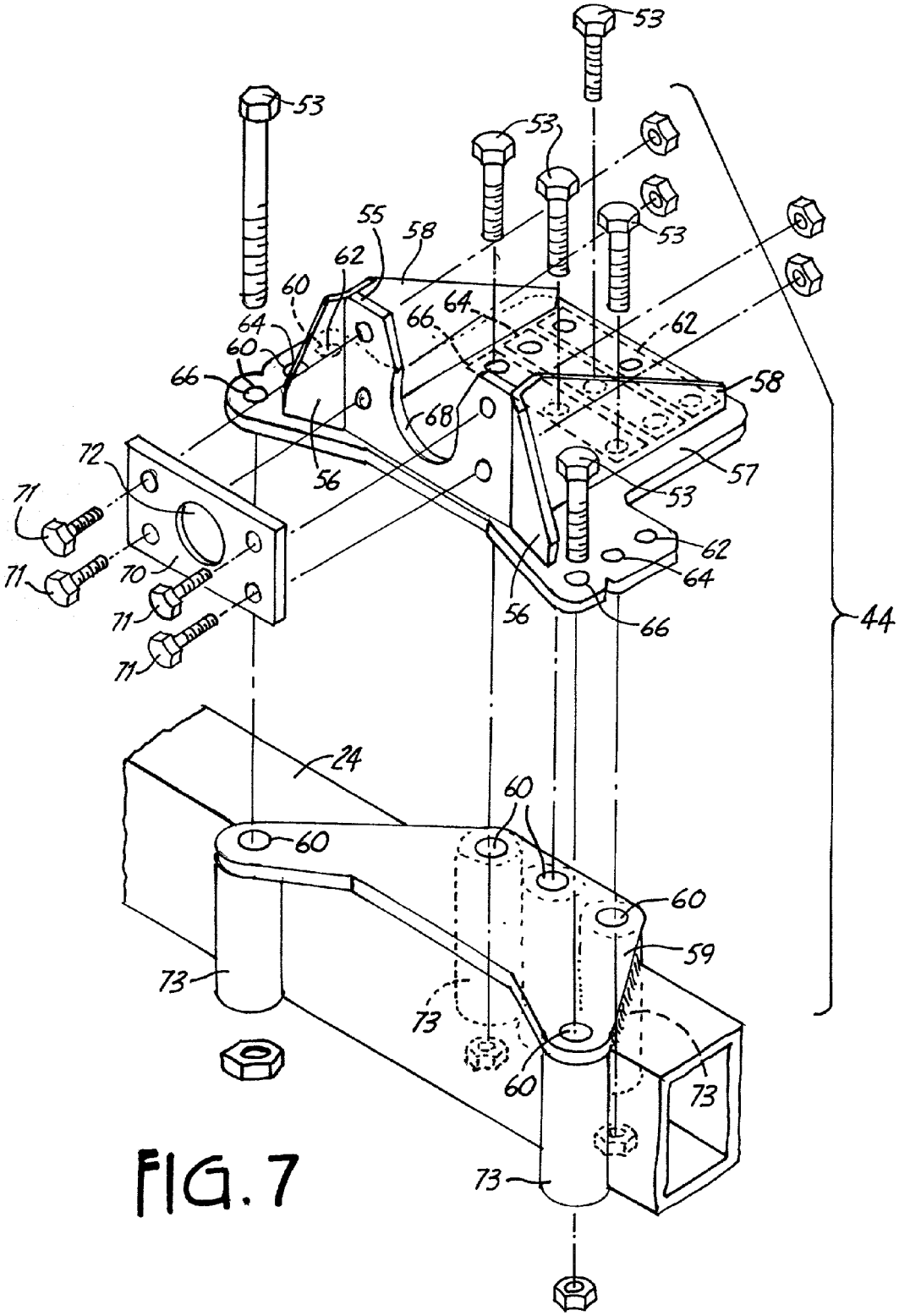
FIG. 7 is an exploded perspective view of a top pin cradle assembly.

An exemplary pin cradle assembly 40 of the inventive mast support assembly 10 is shown in FIG. 7. The pin cradle assembly 40 includes a pin support plate 55 shown with gussets 56, a cradle mounting flange 57, cradle stiffeners 58 and a truss mounting plate 59. Cradle mounting holes 60 are disposed in the cradle mounting flange 57 and the truss mounting plate 59. In the embodiment shown, three sets of cradle mounting holes 60 (set one 62, set two 64 and set three 66) extend through the cradle mounting flange 57 although any number of hole sets are contemplated. By aligning the mounting holes 60 of set one 62 or set two 64 or set three 66 with the mounting holes 60 in the truss mounting plate 59, the cradle mounting flange 57, pin support plate 55 and stiffeners 58 are able to be selectively positioned radially inward or outward with respect to the mast 14 as previously discussed and shown. Each truss mounting plate 59 for the pin cradle assemblies 40 is fixably secured to the top frame tubes 24 (typically by welding). Although illustrated as top frame tubes 24, a substantially similar configuration can be used with bottom frame tubes 26. Additionally, although the embodiment shown uses three sets of mounting holes (set one 62, set two 64, and set three 66) to allow for the adjustment of the cradle mounting flange 57 with respect to the truss mounting plate 59, other methods may be used to position the cradle mounting flange 57. For example, radial slots which extend through the cradle mounting flange 57 could be used in place of the cradle mounting holes 60 (discussed further with respect to FIG. 10).

The pin support plate 55 includes a pin rest surface 68 onto which the cross pin is placed. In one embodiment, cross pin support plate 70 is provided and mounted (typically using bolts 71) to the pin support plate 55. A pin aperture 72 is provided to support the cross pin 46. Different cross pin support plates 70 can be provided having varying thicknesses and cross pin aperture diameters 72 (and shapes) in order to accommodate different size (and shaped) cross pins 46. Cross pins typically are either approximately 3½ inches or 3¼ inches in cross-sectional diameter (although other pin sizes are contemplated by the invention). The pin aperture 72 in the cross pin support plate 70 is preferably chosen to closely match the diameter of the cross pin, providing more effective load transfer between different size pins and the pin support plate 55. The pin support plate 70 distributes localized stresses around the cross pin more effectively than relying on the pin rest 68 alone. Additionally, by providing support around the majority of the pin, the pin can also transfer lifting force to the truss when desirable. For example, when it is necessary to raise or lower the mast and the truss, the mast can be grasped by a crane or derrick, the wall anchorages of the truss removed from the wall, and the entire structure raised or lowered. Thus, the connection between the pin support plate and the pin transfers the lifting force from the mast to the truss.

The cradle mounting bolts 53 are illustrated as being disposed through the third set 66 of cradle mounting holes 60 so that the cradle mounting flange 57 is moved to the extreme radially outward and "largest" mast size position. In the embodiment shown, bolt tubes 73 are welded to the underside of the truss mounting plate 59 below the cradle mounting holes 60 of the truss mounting plate 59. The bolt tubes 73 protect the cradle mounting bolts 53 from impact which could bend or otherwise damage the mounting bolts 51, affecting the ability of the operator to unthread them and adjust the pin cradle assembly 40. The bolt tubes 73 allow long mounting bolts 51 to be used, so that the bolts 51 extend below the frame tubes (here illustrated as top frame tube 24). This makes the bolts 53 more accessible during adjustment of the pin cradle assembly 40.

Figure 8:
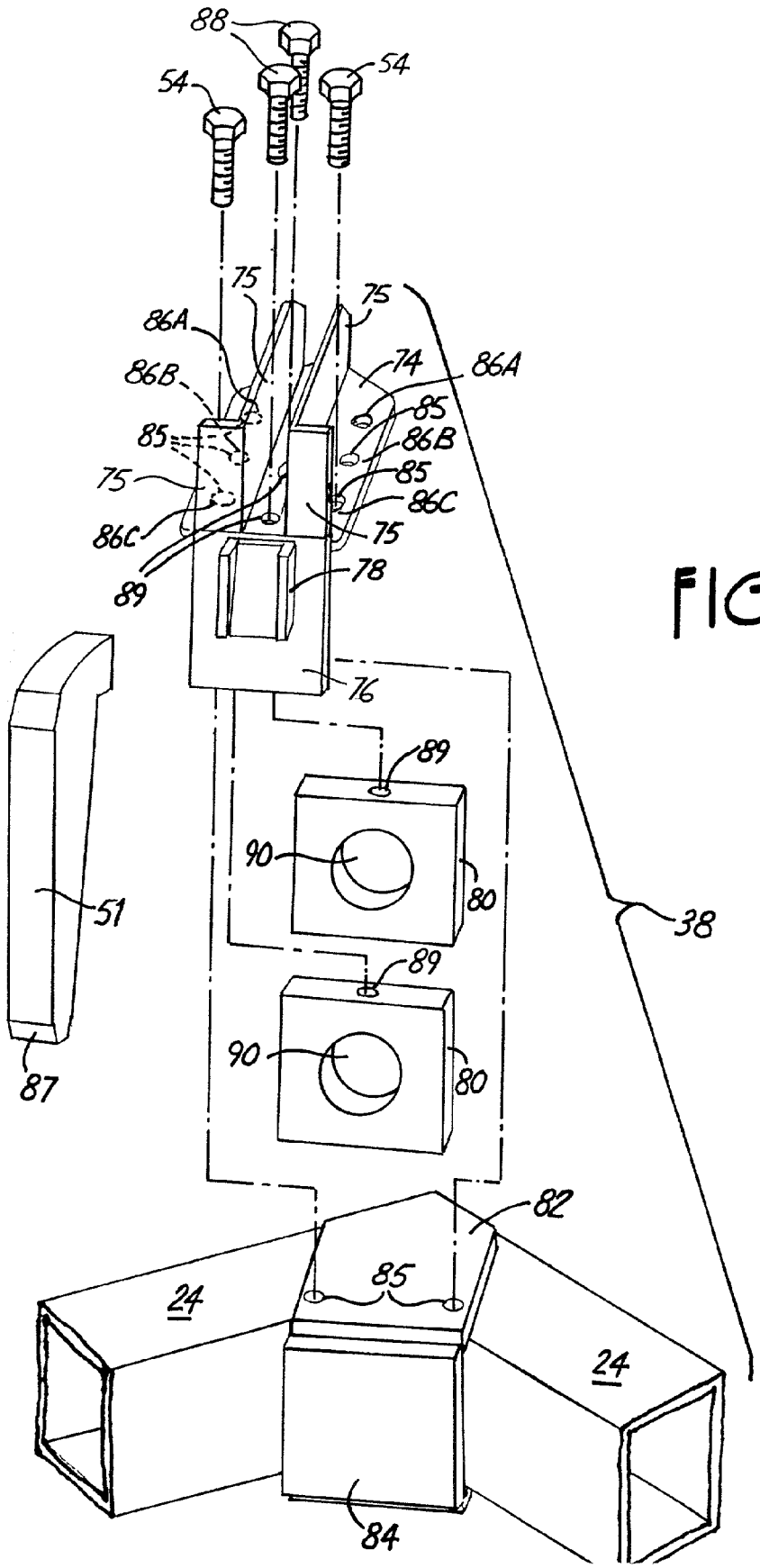
FIG. 8 is an exploded perspective view of a top wedge bracket assembly.

An exemplary wedge bracket assembly 38 is shown in FIG. 8. The wedge bracket assembly 38 includes a bracket mounting flange 74, bracket stiffeners 75, a wedge plate 76, a wedge pocket 78, spacers 80, a bracket mounting plate 82 and a spacer bearing plate 84.

The bracket mounting plate 82 and the bearing plate 84 are fixably secured to the frame tubes 24, typically by welding. Although illustrated as top wedge bracket assembly 38 and top frame tubes 24, it would be understood that a similar configuration could be used with bottom wedge bracket assembly 42 and bottom frame tubes 26, as further discussed with respect to FIG. 9. Similar to the cradle mounting flange 57 described above, the bracket mounting flange 74 contains bracket mounting holes 85 disposed so that the bracket mounting flange 74 can be positioned in selectable positions (set 1 at 86A, set 2 at 86B and set 3 at 86C) with respect to the bracket mounting plate 82 (and the mast). The bracket mounting flange 74 is positioned radially inward or outward (with respect to the mast) by removing the wedge bracket bolts 54 and disposing the bracket mounting flange 74 radially inward (towards the mast) or outward (away from the mast), and re-inserting the wedge bracket bolts 54, which may be bolted directly into threaded mounting holes 85 in the bracket mounting plate 82 or alternatively secured using nuts and washers. Wedge 51 is then driven between the outer surface of the mast 15 (as shown and described previously) and the wedge pocket 78, typically using a sledge hammer. The wedge 51 is first positioned at its tip 87 in the wedge pocket 78. The wedge pocket 78 provides a guide for the wedge 87 as it is driven. It should be noted that wedges can be further secured to the wedge bracket assembly 38 using tie rods or the tie bolts (not shown) which prevent wedges 82 from pulling out when lifting mast for lift truss (as previously described) or during operation.

Spacers 80 are preferably inserted or removed from between the spacer bearing plate 84 and the wedge plate 76, depending on the selected position of the wedge bracket assembly 38. As the bracket mounting flange 74 is disposed radially inward (i.e., for a smaller diameter mast), spacers 80 are added and secured in place by mounting a spacer bolt 88 through spacer mounting holes 89 located in the bracket mounting flange 74 and the spacers 80. The spacers 80 provide a solid block of material between the wedge plate 76 and the spacer bearing plate 84 allowing an effective transfer of load between the frame 24 and the wedge 51. When the bracket mounting flange 74 is moved radially outward (i.e., for a larger diameter mast), one or more spacers 80 can be removed. Lightening holes 90 may be provided in the spacers 80 (as well as in other components of the mast support assembly 10, such as the stiffening plate 48, discussed previously) to lighten the weight of the spacers 80.

Figure 9:
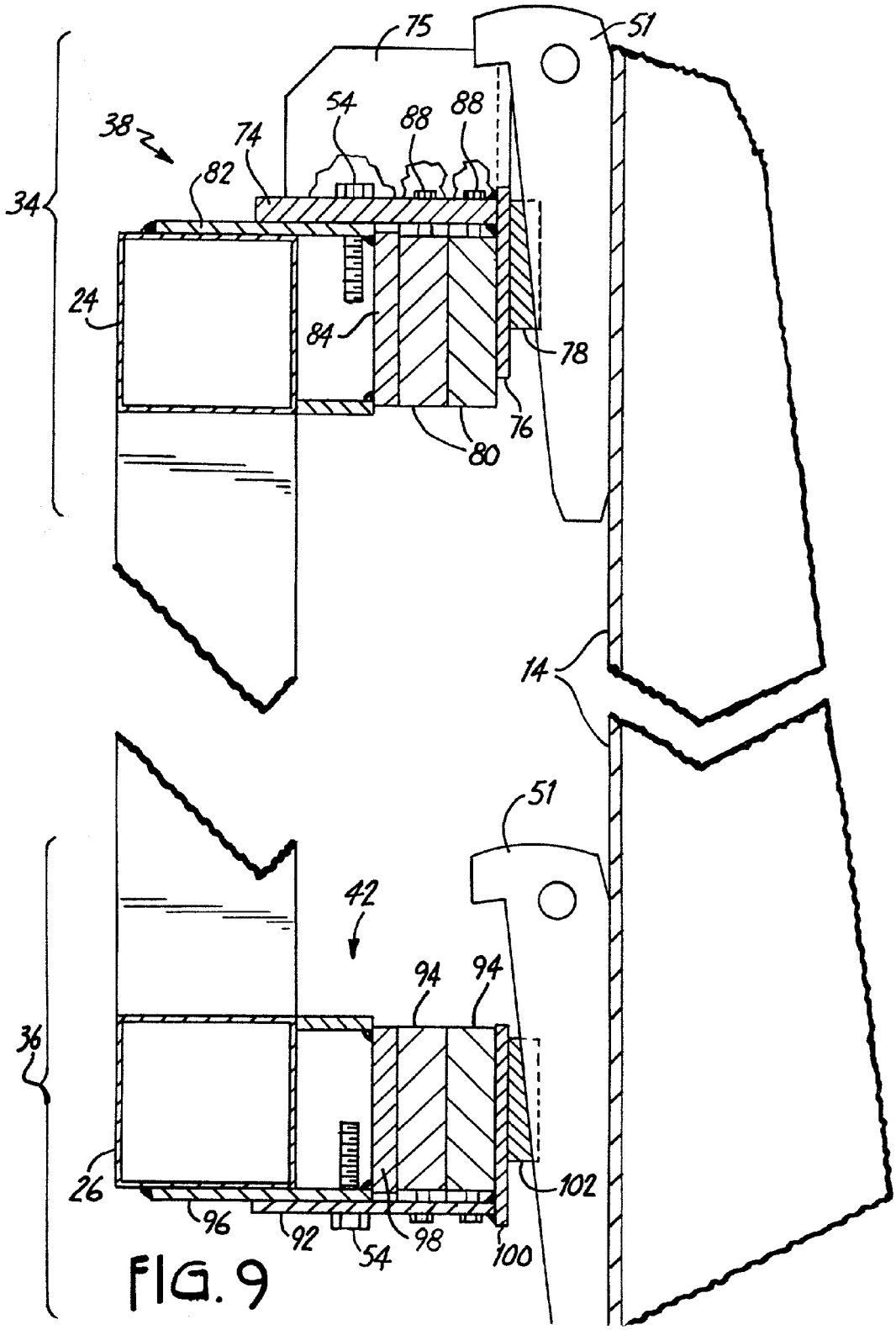
FIG. 9 is a partial cross-sectional view of the top and bottom adjustable mount assemblies.

While the general configuration of the wedge bracket assemblies has been described with respect to the top wedge bracket assemblies 38 and the top adjustable mount assembly 34, the bottom wedge bracket assemblies 42 are configured in generally the same fashion as the top wedge bracket assemblies 38. As can be seen in FIG. 9, the bottom wedge bracket assemblies 42 are flipped (about a horizontal axis) compared to the top wedge bracket assemblies 38. In other words, in the top wedge bracket assemblies 38 the bracket mounting flange 74 is located above the spacers 80 whereas in the bottom wedge bracket assemblies 42 a bracket mounting flange 92 is mounted below spacers 94. A bracket mounting plate 96 is mounted to the bottom frame tubes 26 (again, typically by welding). In the illustrated embodiment, no bracket stiffeners are provided in the bottom wedge bracket assemblies 42 (although they could be provided without departing from the spirit and scope of the invention).

During adjustment of the bottom wedge bracket assemblies 42, the spacers 94 are alternately disposed or removed between a spacer bearing plate 98 and the wedge plate 100 depending on the diameter of the mast 14. A wedge 51' is driven downward into a wedge pocket 102 to prevent the mast 14 from moving radially (transversely) within the bottom adjustable mount assembly 36.

The dual support provided by the top adjustable mount assembly 34 and the bottom adjustable mount assembly 36 prevents the mast 14 from tipping from its vertical position while still allowing the mast 14 to be raised, lowered, or replaced with a different size mast 14'. Again, although pin cradle assemblies are not shown as part of the bottom adjustable mount assembly 36, in an alternate embodiment, they can be included to provide additional support and stability to the mast 14'.

Figure 10:
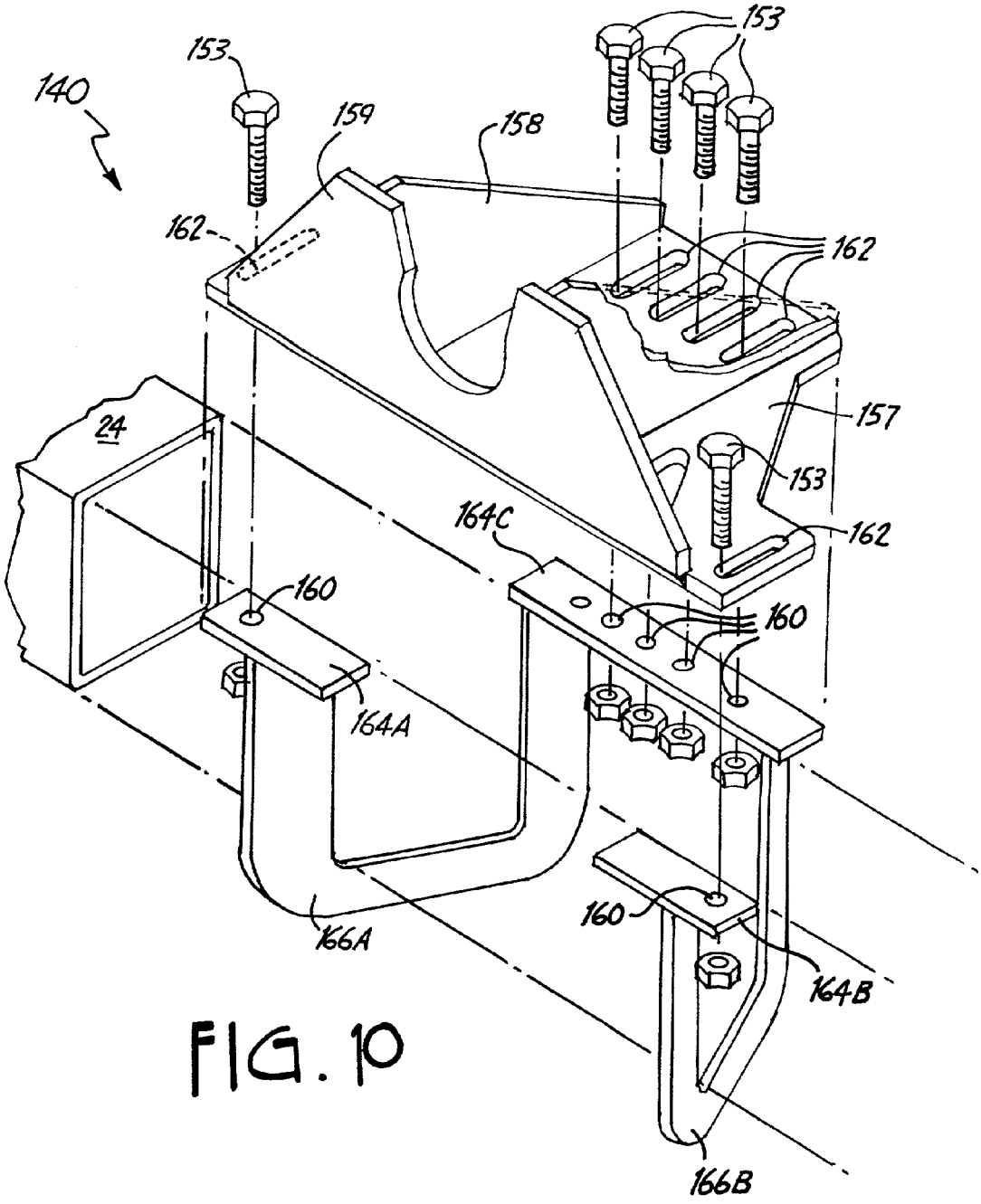
FIG. 10 is an exploded perspective view of an alternate embodiment of the top pin cradle assembly.

An alternate configuration for the pin cradle assembly is shown in FIG. 10 at 140. The pin cradle assembly 140 includes a pin support plate 155, a cradle mounting flange 157, cradle stiffeners 158 and a truss mounting bracket 159. Cradle mounting holes 160 are disposed in the truss mounting bracket 159. As was previously discussed, slots 162 are utilized in one embodiment of the pin cradle assembly 140 to allow the radially inward or outward disposition of the cradle mounting flange 157. Cradle mounting bolts 153 are inserted through the slots 162 and cradle mounting holes 160 and tightened (e.g., with nuts or by using threaded cradle mounting holes). To change the position of the cradle mounting flange 157, cradle stiffeners 158 and truss mounting bracket 159, the cradle mounting bolts 153 are loosened, the cradle mounting flange 157 is slid radially inward or outward (with respect to the mast) and the cradle mounting bolts 153 are retightened at the desired position. Additionally, the truss mounting bracket 159 may be used in place of the truss mounting plate discussed previously with respect to FIG. 7. The truss mounting bracket 159 includes support mounting plates 164A, 164B and 164C, and U-shaped legs 166A and 166B which extend under the frame tubes 24. The cradle mounting holes 160 are disposed through the mounting plates 164A–164C. The mounting plates 164A–164C provide mounting surfaces for the cradle mounting flange 157. Additionally, as shown in FIG. 10, the pin support plate 155 may be a generally flat surface and does not necessarily include support wings, as discussed previously. It should be noted that features of the embodiment of the cradle assembly 140 (illustrated in FIG. 10) can be intermixed with features of the cradle assembly 40 (illustrated in FIG. 7) without departing from the spirit and scope of the invention.

Figure 11:
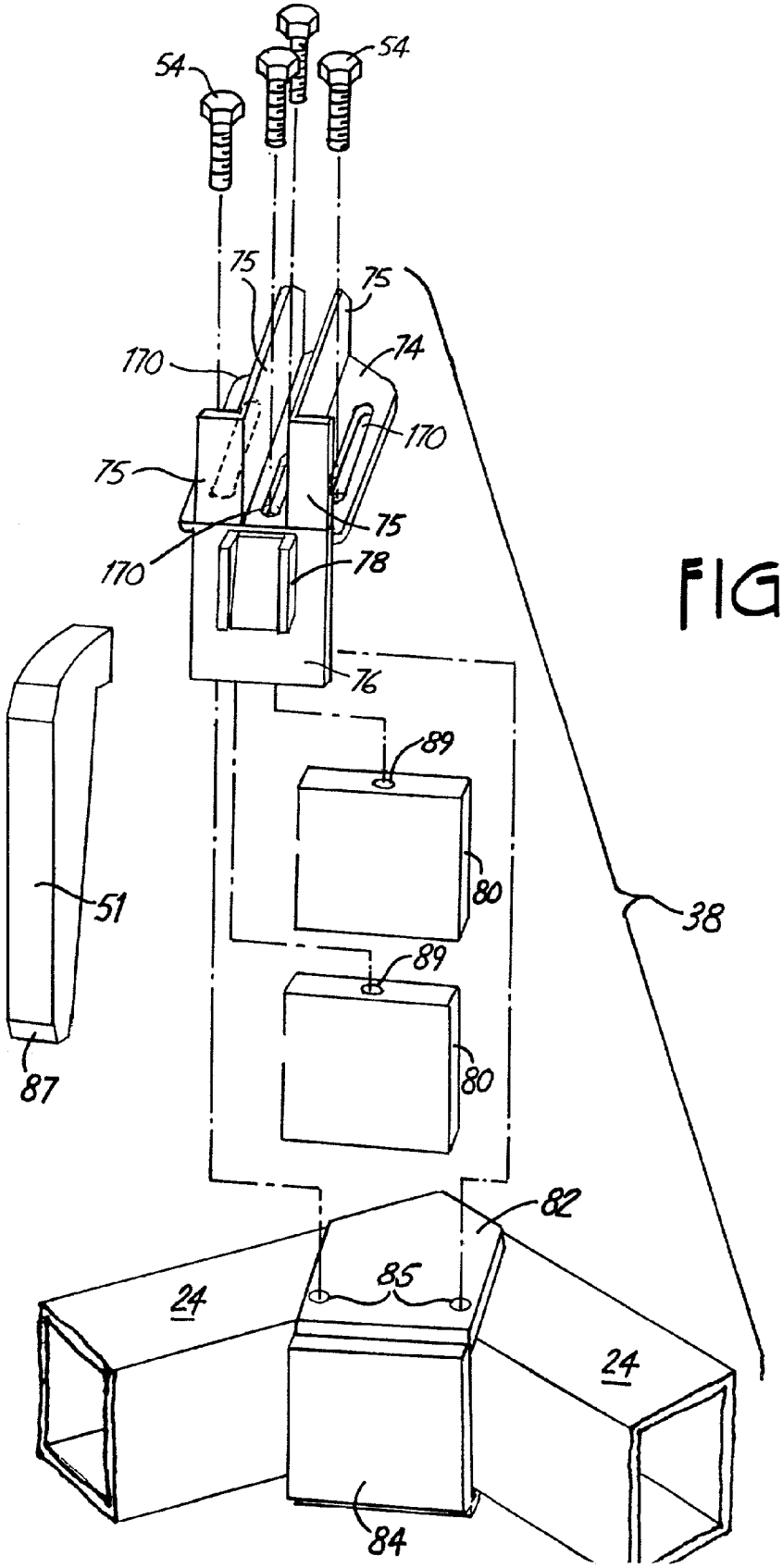
FIG. 11 is an exploded perspective view of an alternate embodiment of a top wedge bracket assembly.

FIG. 11 shows an alternate embodiment of the top wedge bracket assembly 38 utilizing slots 170 to allow for the selective positioning of the wedge bracket assembly 38. Similar in function to the pin cradle assembly 140 described with respect to FIG. 10, the slots 170 allow the wedge bracket assembly 38 to be slid radially inward or outward (towards or away from the mast). The wedge bracket bolts 54 can be tightened at any position along the length of the slot 170.

Although the preferred material used for components of the mast support assembly 10 is steel, other materials are known in the art which may be used without departing from the spirit and scope of the invention (e.g., aluminum, titanium or composites). Finally, as previously discussed, it should be realized that the wedge bracket assemblies 38 and pin cradle assemblies 40 can be disposed at different positions about the top frame tubes 24 and bottom frame tubes 26 without departing from the spirit and scope of the invention. For example, the configuration of pin cradle assemblies 40 and wedge bracket assemblies 38 shown in FIGS. 3–6 could be rotated 45° with respect to the top frame tubes 24A–24D such that the pin cradle assemblies 40 are located in the corners of the area 50 defined by the top frame tubes 24A–24D and the wedge bracket assemblies 38 are located in the middle of the length of each of the top frame tubes 24A–24D.

The inventive adjustable structural support system is able to receive a variety of mast sizes. The mast is capable of receiving and supporting operating loads of a variety of equipment, including but not limited to, conveying booms, hoisting cranes, derricks, personnel lifts, etc. The adjustable structural support system can be affixed to permanent or temporary structures, including but not limited to, concrete walls or floors, steel frame work, structural pilings, ballasted frames, marine barges, etc. The ability to receive various mast sizes is realized through the use of adjustable bracketry, spacers and associated hardware. The further use of wedges, bolted connections and pins provides effective load transfer between the mast and the adjustable structural support system.

The adjustability of the inventive mast support assembly 10 is advantageous for an equipment owner/operator in order to limit his/her equipment capital costs since it allows him/her to have interchangeable parts, e.g. structural support systems. The inventive mast support assembly 10 reduces warehouse storage and hardware requirements by providing one equipment structural support system capable of receiving and resisting the reactions of various mast sizes. The inventive mast support assembly 10 allows the mast to be inserted into the structural support system, thus providing two or more points of support for the mast and allows the mast to be adjusted vertically within the fixed structural support system.

Although the present invention has been described with reference to preferred embodiments, workers skilled in the art will recognize that changes may be made in form and detail without departing from the spirit and scope of the invention.

The invention claimed is:

1. A support apparatus for a construction mast comprising:

a truss for fixed connection to a vertical surface, the truss including a top frame defining a first aperture for receiving a construction mast;

a bottom frame defining a second aperture for receiving the construction mast;

vertical members connecting the top frame and the bottom frame; and lacing members extending between the vertical members; and a top adjustable mount assembly mounted to the top frame, wherein the top adjustable mount assembly includes a plurality of mast engaging elements positioned at spaced locations on the top frame and adjustable with respect to the top frame to extend radially inward for securing the construction mast.

2. The support apparatus of claim 1 comprising:

a bottom adjustable mount assembly mounted to the bottom frame, wherein the bottom adjustable mount assembly includes a plurality of mast engaging elements positioned at spaced locations on the bottom frame and adjustable with respect to the bottom frame to extend radially inward for securing the construction mast.

3. The support apparatus of claim 1, wherein the plurality of mast engaging elements of the top adjustable mount assembly comprises:

a plurality of top wedge bracket assemblies; and a plurality of pin cradle assemblies.

4. The apparatus of claim 1, wherein the plurality of mast engaging elements of the top adjustable mount assembly comprises:

four top wedge bracket assemblies; and two pin cradle assemblies.

5. The apparatus of claim 2, wherein the plurality of mast engaging elements of the bottom adjustable mount assembly comprises:

a plurality of bottom wedge bracket assemblies.

6. The apparatus of claim 3, wherein each of the pin cradle assemblies comprises:

a truss mounting plate fixably mounted to the top frame of the truss;

a cradle mounting flange selectively positionable with respect to the truss mounting plate; and a pin support plate fixed to the cradle mounting flange and shaped so as to receive a cross pin.

7. The apparatus of claim 6, wherein mounting bolts are alternately disposable through at least two sets of mounting holes in the cradle mounting flange so as to allow the selective positioning of the cradle mounting flange with respect to the truss mounting plate.

8. The apparatus of claim 6, wherein mounting bolts are disposed through slots in the cradle mounting flange so as to allow the selective positioning of the cradle mounting flange with respect to the truss mounting plate.

9. The apparatus of claim 3, wherein each of the wedge bracket assemblies comprises:

a bracket mounting plate fixably mounted to the top frame of the truss;

a bracket mounting flange selectively positionable with respect to the bracket mounting plate;

a wedge plate fixed to the bracket mounting flange; and a wedge positionable between the wedge plate and the construction mast.

10. The apparatus of claim 9 and comprising:

at least one spacer disposed against the wedge plate.

11. The apparatus of claim 9 wherein mounting bolts are alternately disposable through at least two sets of mounting holes in the bracket mounting flange so as to allow the selective positioning of the bracket mounting flange with respect to the bracket mounting plate.

12. The apparatus of claim 9 wherein mounting bolts are disposed through slots in the bracket mounting flange so as to allow the selective positioning of the bracket mounting flange with respect to the bracket mounting plate.

13. The apparatus of claim 5, wherein each of the bottom wedge bracket assemblies comprises:

a bracket mounting plate fixably mounted to the bottom frame;

a bracket mounting flange selectively positionable with respect to the bracket mounting plate;

a wedge plate fixed to the bracket mounting flange; and a wedge positionable between the wedge plate and the construction mast.

14. The apparatus of claim 13 and comprising:

at least one spacer disposed against the wedge plate.

15. A support frame for receiving a mast comprising:

a truss having top frame tubes and bottom frame tubes;

a plurality of top wedge bracket assemblies secured to the top frame tubes equidistantly from each other, each top wedge bracket assembly having a top bracket mounting plate fixably mounted to the top frame tubes, a top bracket mounting flange selectively positionable with respect to the top bracket mounting plate, a top wedge plate fixed to the top bracket mounting flange, and a top wedge positionable between the top wedge plate and the construction mast;

a plurality of pin cradle assemblies secured to the top frame tubes, each pin cradle assembly having a truss mounting plate fixably mounted to the top frame tubes, a cradle mounting flange selectively positionable with respect to the truss mounting plate, and a pin support plate fixed to the cradle mounting flange and shaped so as to receive a cross pin; and a plurality of bottom wedge bracket assemblies secured to the bottom frame tubes equidistantly from each other, each bottom wedge bracket assembly having a bottom bracket mounting plate fixably mounted to the bottom frame tubes, a bottom bracket mounting flange selectively positionable with respect to the bottom bracket mounting plate, a bottom wedge plate fixed to the bottom bracket mounting flange, and a bottom wedge positionable between the bottom wedge plate and the mast.

16. The frame of claim 15, wherein each top wedge bracket assembly comprises:

a top spacer bearing plate fixably mounted to the top frame tubes; and at least one spacer disposed between the top spacer bearing plate and the top wedge plate.

17. The frame of claim 15 wherein the truss is shaped so as to receive the mast, wherein the mast has an outer diameter of from approximately 24 inches to approximately 32 inches.

18. A support frame for receiving any one of a plurality of masts having different cross-sectional diameters, the support frame comprising:

a truss for fixed connection to a vertical surface, the truss including a top frame portion defining a top opening;

a bottom frame portion defining a bottom opening;

vertical members connecting the top frame portion and the bottom frame portion; and lacing members extending between the vertical members; and a top adjustable support assembly mounted to the top frame portion and extending into the top opening, the top adjustable support assembly being adjustable in size for supportably receiving and holding in place any one of the plurality of masts at the top frame portion; and a bottom adjustable support assembly mounted to the bottom frame portion and extending into the bottom opening, the bottom adjustable support assembly being adjustable in size for supportably receiving and holding in place any one of the plurality of masts at the bottom frame portion.

19. The support frame of claim 18 comprising:

a top wall anchorage fixably secured to the top frame portion and adapted so as to be mountable to a vertical surface.

20. The support frame of claim 18 comprising:

a bottom wall anchorage fixably secured to the bottom frame portion and adapted so as to be mountable to a vertical surface.

21. A support apparatus for a construction mast comprising:

a truss;

a top adjustable mount assembly secured to the truss wherein the top adjustable mount assembly is selectively positionable for engaging a construction mast, and the top adjustable mount assembly comprises:

at least one wedge bracket assembly; and at least one pin cradle assembly including a truss mounting plate fixably mounted to a top frame portion of the truss;

a cradle mounting flange selectively positionable with respect to the truss mounting plate; and a pin support plate fixed to the cradle mounting flange and shaped so as to receive a cross pin.

22. The apparatus of claim 21, wherein mounting bolts are alternately disposable through at least two sets of mounting holes in the cradle mounting flange so as to allow the selective positioning of the cradle mounting flange with respect to the truss mounting plate.

23. The apparatus of claim 21, wherein mounting bolts are disposed through slots in the cradle mounting flange so as to allow the selective positioning of the cradle mounting flange with respect to the truss mounting plate.

24. A support apparatus for a construction mast comprising:

a truss;

a top adjustable mount assembly secured to the truss wherein the top adjustable mount assembly is selectively positionable for engaging a construction mast, and the top adjustable mount assembly comprises:

at least one pin cradle assembly; and at least one wedge bracket assembly including a bracket mounting plate fixably mounted to a top frame portion of the truss;

a bracket mounting flange selectively positionable with respect to the bracket mounting plate;

a wedge plate fixed to the bracket mounting flange; and a wedge positionable between the wedge plate and the construction mast.

25. The apparatus of claim 24 further comprising:

at least one spacer disposed against the wedge plate.

26. The apparatus of claim 24 wherein mounting bolts are alternately disposable through at least two sets of mounting holes in the bracket mounting flange so as to allow the selective positioning of the bracket mounting flange with respect to the bracket mounting plate.

27. The apparatus of claim 24 wherein mounting bolts are disposed through slots in the bracket mounting flange so as to allow the selective positioning of the bracket mounting flange with respect to the bracket mounting plate.

28. A support apparatus for a construction mast comprising:

a truss;

a top adjustable mount assembly secured to the truss wherein the top adjustable mount assembly is selectively positionable for engaging a construction mast; and a bottom adjustable mount assembly mounted to a bottom frame portion of the truss, including at least one bottom wedge bracket assembly wherein the bottom wedge bracket assembly is selectively positionable with respect to the bottom frame portion for engaging the construction mast, and each bottom wedge bracket assembly comprises:

a bracket mounting plate fixably mounted to a bottom frame portion;

a bracket mounting flange selectively positionable with respect to the bracket mounting plate;

a wedge plate fixed to the bracket mounting flange; and a wedge positionable between the wedge plate and the construction mast.

29. The apparatus of claim 28 further comprising:

at least one spacer disposed against the wedge plate.

* * * * *

UNITED STATES PATENT AND TRADEMARK OFFICE

CERTIFICATE OF CORRECTION

PATENT NO. : 7,114,690 B2
APPLICATION NO. : 10/043066
DATED : January 9, 2002
INVENTOR(S) : David R. Bissen It is certified that error appears in the above-identified patent and that said Letters Patent is hereby corrected as shown below:

Column 2, Front Page, under References Cited,
delete "6,585,207 B1", insert --6,585,207 B2--

Column 2, Front Page, under References Cited,
delete "6,752,368 B1", insert --6,752,368 B2--

Signed and Sealed this

Fourteenth Day of August, 2007

JON W. DUDAS
*Director of the United States Patent and Trademark Office*

UNITED STATES PATENT AND TRADEMARK OFFICE

CERTIFICATE OF CORRECTION

PATENT NO. : 7,114,690 B2
APPLICATION NO. : 10/043066
DATED : October 3, 2006
INVENTOR(S) : David R. Bissen It is certified that error appears in the above-identified patent and that said Letters Patent is hereby corrected as shown below:

Column 2, Front Page, under References Cited,
delete "6,585,207 B1", insert --6,585,207 B2--

Column 2, Front Page, under References Cited,
delete "6,752,368 B1", insert --6,752,368 B2--

This certificate supersedes Certificate of Correction issued August 14, 2007.

Signed and Sealed this

Fourth Day of September, 2007

JON W. DUDAS
*Director of the United States Patent and Trademark Office*